United States Patent [19]

Fundom

[11] 4,399,925

[45] Aug. 23, 1983

[54] POURING SPOUT STEEL CAN END CONSTRUCTION

[75] Inventor: Danny L. Fundom, Massillon, Ohio

[73] Assignee: Van Dorn Company, Cleveland, Ohio

[21] Appl. No.: 369,216

[22] Filed: Apr. 16, 1982

[51] Int. Cl.[3] ..... B65D 17/34

[52] U.S. Cl. ..... 220/269; 220/273

[58] Field of Search ..... 220/269–273, 220/276

[56] References Cited

U.S. PATENT DOCUMENTS

| | | | |
|---|---|---|---|
| 3,437,227 | 4/1969 | Peyser | 220/269 |
| 3,967,752 | 7/1976 | Cudzik | 220/269 |
| 3,967,753 | 7/1976 | Cudzik | 220/269 |
| 4,042,144 | 8/1977 | Henning et al. | 220/273 |
| 4,210,257 | 7/1980 | Radtke | 220/269 |
| 4,211,335 | 7/1980 | Langseder | 220/269 |
| 4,289,251 | 9/1981 | Maliszewski | 220/269 |

*Primary Examiner*—George T. Hall

*Attorney, Agent, or Firm*—Frease & Bishop

[57] ABSTRACT

A pouring spout steel can end construction for liquid human food products in which a steel can end is provided which may be opened easily with an aluminum pull tab riveted to a flat panel portion of the can end. The flat panel portion has a pouring spout opening defined by a score line when panel metal is torn from the can end along the score line. The torn metal does not contaminatingly project into the container during opening and remains connected to the can end.

7 Claims, 15 Drawing Figures

POURING SPOUT STEEL CAN END CONSTRUCTION

CROSS-REFERENCE TO RELATED PATENT APPLICATION

The pouring spout can end of this application is a different species of steel can end from that disclosed in copending U.S. Baumeyer et al. application Ser. No. 351,869, filed Feb. 24, 1982, which is owned by the Assignee of this application.

BACKGROUND OF THE INVENTION

1. Field of the Invention

The invention relates to a metal can for special liquid formulas for infants, liquid supplements for senior citizens, and other similar preparations that must not be contaminated. More particularly, the invention relates to a can for such liquid products provided with a can end member which may be opened easily by tearing loose a panel portion of the can end member along a score line defining a pear-shaped pouring spout opening with a ring pull tab preferably formed of aluminum.

Also, the invention relates to such a can end fabricated from light gauge steel wherein the torn panel portion is non-detachable and after opening remains connected to the can and can end member along with the pull tab riveted thereto. In addition, the non-detachable torn portion, in accordance with the invention, does not project to any material degree into the can during opening, and is not located within the can after opening, thereby avoiding contamination of liquids of the character described that are contained in the can.

Finally, the invention relates to a new steel can end in which a pouring spout or opening is formed in a flat panel portion of the end by rupturing the end panel portion on an opening-defining score line close to the can end seam with the tip of an aluminum pull tab such as shown in U.S. Pat. No. 4,042,144, riveted to the portion to be torn.

2. Description of the Prior Art

Steel can ends for beverage cans are known having small teardrop or keyhole-shaped openings formed in the can end wall by pulling keyhole-shaped metal completely from the can end with a pull tab attached to the removed metal by a rivet located at or near to the center of the can end.

Also, beverage cans are known which have pull tabs attached to torn teardrop metal portions, both of which remain attached to the can after forming the pouring opening. In general in such cans, the torn metal portion remains inside the can. Examples of such non-detachable torn portions projected, pushed or otherwise located inside the can when the can is opened are contained in U.S. Pat. Nos. 3,967,752, 3,967,753, 4,210,257, 4,211,335 and 4,289,251.

Another steel can end is known used for closing cans containing anti-rust and water pump lubricants for automobile radiator systems. In this prior construction a large open "U" score-tear line is formed in the can end encompassing nearly one half of the end panel area, to form an opening substantially larger than the pull tab used to rupture the can end. The pull tab is riveted centrally to the end panel by ears extending within and connected to the pull ring opening. Also, the pull tab is riveted to the can end adjacent the tip of the pull tab and to a portion of the panel to be torn at a location near to the can end seam. This construction can be opened only by prying the pull ring portion of the pull tab with the screwdriver to tear the pull ring free from the central rivets. Then the can is opened by tearing the U-shaped portion with the pull tab to project the large torn portion first into the can and the liquid therein and then out of the can.

Another prior can end with a detachable pulled-out portion ruptured and pulled from a can end formed of aluminum is known wherein the opening formed is larger than and encircles the location of the pull tab riveted thereto, the pull tab being of the type shown in said U.S. Pat. No. 4,042,144. This can end is reinforced by ribs formed in the end panel at each side of the pull tab and of the endless score line defining the detachable pulled-out portion. Containers equipped with such can ends serve as containers for salad croutons.

Still another prior can end is known formed of aluminum with an open hourglass U-shaped tear score line defining an opening to be formed therein with convex embossments located at either side of the "U" legs with a matching contour; with a rigid pull tab riveted at its nose close to the wide outer end of the score line adjacent a depressed endless recess connecting the flat panel wall in which the score line is formed with the seam flange on the can end; and with a short bend score line in the undersurface of the flat panel wall located behind a horseshoe-like downward embossment semicircularly surrounding the rivet. In opening this can end, the pull tab ruptures the tear score line and the ruptured portion is projected into the can by bending panel metal on the bend score line behind the rivet. An indication on the can end directs the user to "push down"; thus, while an opening in this prior device is formed by tearing a non-detachable metal panel portion to which the pull tab is riveted from the flat panel, torn portions are pushed down into the can during opening which can contaminate any liquid in the can.

None of the various prior art devices described are suitable for providing a small pear-shaped pouring spout opening in an end panel of a steel can end wherein the torn-out portion does not project into or contaminate the special liquid food for human consumption in the can which must not be contaminated during opening, and in which the torn-out pouring spout opening forming portion is not detached but remains connected with the can end.

Accordingly, there is an existing need in the art for a can for liquid human food products provided with a steel can end which may be easily opened with an aluminum pull tab riveted to a panel portion wherein the pouring spout opening forming portion is torn from the can end without contaminatingly-projecting into the container during openings and without becoming detached from the can end.

SUMMARY OF THE INVENTION

Objectives of the invention include providing a new steel can end construction having a panel portion in which a small pear-shaped pouring spout opening is formed by tearing away metal in a flat portion of the end panel along a score line defining the pouring spout opening without contaminatingly-projecting any of the torn-out portion into the can or into its contents during opening of the can; providing such a can end which may be easily opened with a typical aluminum pull tab available and ordinarily used only for opening aluminum can ends; providing such a can end in which the steel portion torn from the end panel along with its pull tab are undetachably connected with the can after forming the pouring spout opening; providing such a can end in which the pouring spout opening-defining score line in the can end panel is located in the valley of a slight downwardly extending embossed-like formation with stiffens the metal along the score line, which embossed-like formation on the one hand, assists easy tearing of the metal along the score line, and, on the other hand, provides a slightly downturned edge for the pouring spout opening when formed; providing such a can end in which the pear-shaped pouring spout opening defined by the score line has a straight portion or contour at its outer wider end located closely adjacent the can end seam to facilitate pouring; providing such a can end in which the riveted connection between the pull tab and can end is located closely adjacent the score line portion defining the straight outer wider end of the pear-shaped opening to be formed; providing such a can end in which a circular reinforcing and stiffening embossment is formed projecting upwardly in the end panel close to the can end seam extending endlessly around the end panel from a zone adjacent but spaced from one rounded corner of the outer wider end of the pear-shaped opening-defining score line to the other rounded corner thereof; providing such a can end in which the aluminum pull tab has a stepped tip overlapping and spaced above the outer wider end portion of the score line when the pull tab is riveted to the end panel so that when the pull portion of the pull tab is raised the pull tab acts as a lever pivoting about a bend portion of the pull tab located between the rivet and tip to dig the tip into the end panel and wipe it across the outer wider end portion of the score line to rupture the end panel along said outer wider score line portion, and to permit a pear-shaped portion of the end panel to be torn upward by upward pull of the pull tab from the end panel without contaminatingly-projecting any of the torn-out portion into the can; and providing such a new steel can end construction to be opened with a pouring spout formed therein which achieves the stated objectives and overcomes difficulties encountered in prior constructions, which can end construction is relatively inexpensive as compared with prior can ends capable of being opened to provide a pouring spout opening with undetached torn-out portions.

These and other objectives and advantages may be obtained by the new pouring spout steel can end construction of the invention which may be stated in general terms as involving a metal can end of a type having a seam flange adapted to be connected by seam means to a can body which can end has a recessed corner located below the seam flange with a flat end panel extending inward from the recessed corner, the flat panel having a pear-shaped score line therein defining a removable portion to be torn from said end panel to form a pouring spout opening when pulled by an aluminum pull tab having a ring end and a bottom nose wall connected by a rivet formed integrally in the flat panel and located close to the score line, the pull tab bottom nose wall having slots therein forming an ear-like portion to which the rivet is connected and having a stepped tip spaced from said ear-like portion; wherein the improvement comprises an annealed, tempered, tin-free steel can end; the pear-shaped score line having an outer wider straight end portion connected by rounded corners with inwardly converging terminal portions having spaced-apart ends; the outer straight end score line portion being located close to the can end recessed corner with the pull tab stepped tip overlying and spaced above the center of the outer straight end score line portion; and the pull tab bottom nose wall and panel wall riveted thereto bending on a bend line extending normal to the longitudinal axis of the pull tab which extends through the rivet and stepped tip with the bend line located between the rivet and stepped tip when the ring end of the pull tab is raised to wipe the tip into and across the score line to initially rupture the score line at said center and to spread the rupture in either direction from said center along the outer straight end score line portion.

BRIEF DESCRIPTION OF THE DRAWINGS

A preferred embodiment of the invention—illustrative of the best mode in which applicant has contemplated applying the principles—is set forth in the following description and shown in the drawings and is particularly and distinctly pointed out and set forth in the appended claims.

Similar numerals refer to similar parts throughout the various figures of the drawings.

DESCRIPTION OF THE PREFERRED EMBODIMENT

Figure 1:
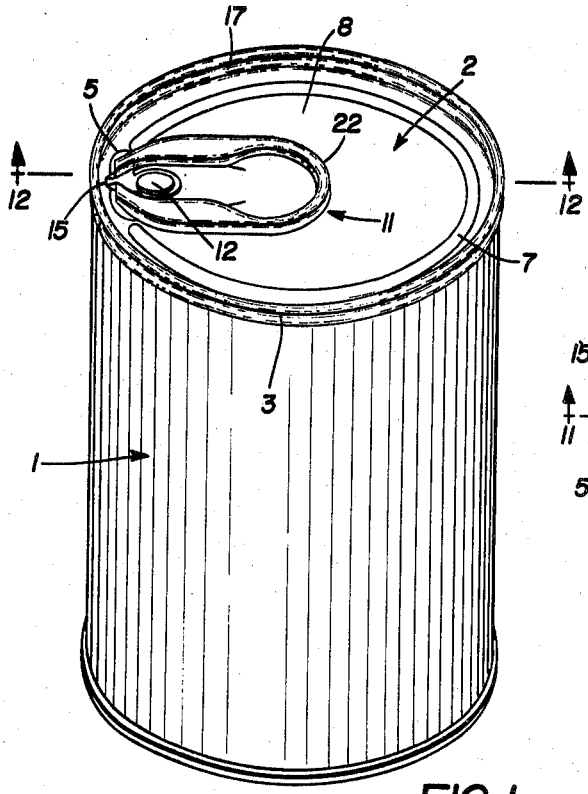
FIG. 1 is a perspective view of a steel can with the new steel pouring spout can end construction of the invention seamed to the upper end of the can.

A generally typical steel can body 1 is illustrated in FIG. 1 with the improved pouring spout steel can end generally indicated at 2 seamed at 3 to the upper end of the side wall of the can body 1.

A stage blank 4 (FIGS. 2 and 3) in a stage of the manufacture of the can end 2 has a score line 5 formed therein which defines the pear-shaped opening to be provided when the can 1 is opened. Before forming the score line 5 in the stage blank 4, a rivet formation 6 is formed in a previous stage blank as well as a circular reinforcing embossment 7 projecting upward from the flat panel wall 8 of the can end 2.

Figure 10:
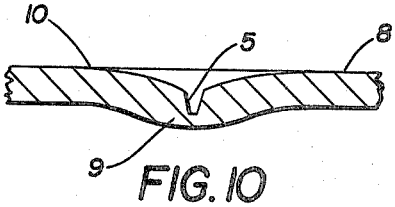
FIG. 10 is an enlarged fragmentary sectional view taken on the line 10—10, FIG. 7.

When a score line such as shown at 5 is formed in light gauge steel with scoring dies to penetrate the metal a sufficient distance, described in detail below, so that the residual metal thickness at the bottom of the score can be readily ruptured with a pull tab riveted to the portion to be torn out, there is a deformation of the metal in the scored area or zone which results in a slight embossed-like concave depression in the metal, indicated at 9 in FIG. 10, extending along either side of the cross-sectional contour of the score 5. The concavity noted extends slightly downward from the scored surface 10 of the metal in the flat panel wall 8.

Figure 4:
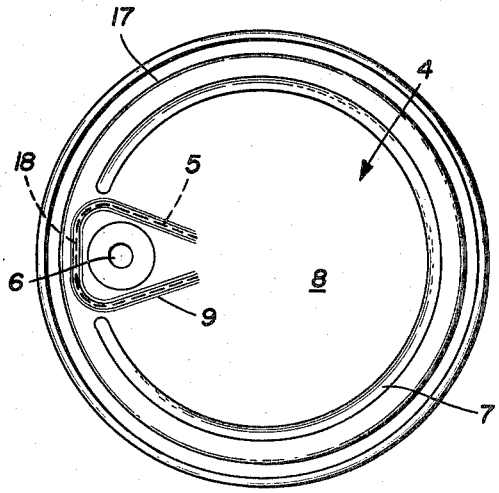
FIG. 4 is a bottom plan view of the can end stage blank shown in FIG. 2.

This concavity 9 provides a slight embossed-like projection indicated by shading when viewing (as in FIG. 4) the bottom surface of the flat panel wall 8 of the stage blank 4.

Figure 5:
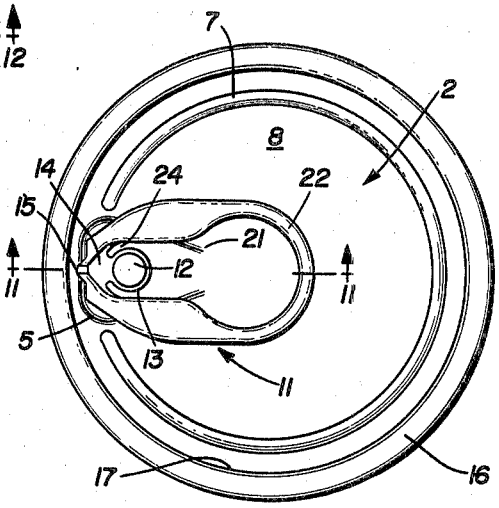
FIG. 5 is a plan view of the completed can end after staking a pull tab to the stage blank of FIGS. 2–4.
Figure 2:
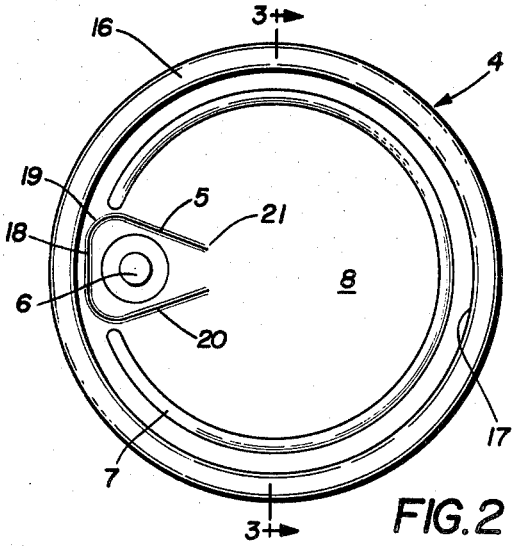
FIG. 2 is a plan view of the new can end in one stage of manufacture after forming a score line in its flat panel wall defining the pouring spout opening to be formed when opening the can.
Figure 3:
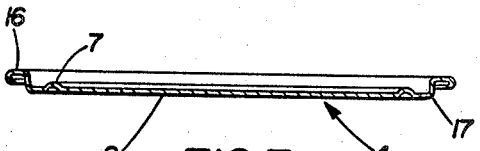
FIG. 3 is a sectional view of the can end of FIG. 2 taken on the line 3—3, FIG. 2.

After the score line 5 has been formed to provide stage blank 4, a pull tab generally indicated at 11 is staked to the can end by completing the rivet 12 (FIG. 5) from the rivet formation 6 of FIG. 2. This completes the assembly of the improved can end 2 as shown in FIG. 5.

The pull tab 11 preferably is an aluminum pull tab such as the pull tab shown in U.S. Pat. No. 4,042,144. The rivet 12 extends through and engages an opening formed in an ear-like portion 13 comprising a part of the nose bottom wall 14 of pull tab 11.

Figure 11:
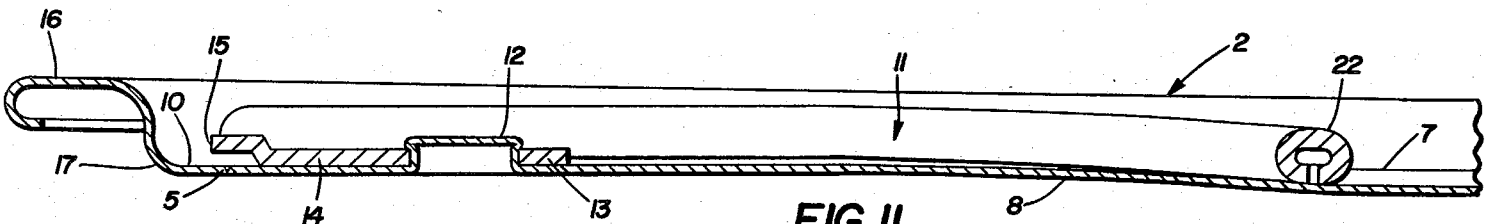
FIG. 11 is a greatly enlarged sectional view taken on the line 11—11, FIG. 5.

The nose bottom wall 14 of the pull tab 11 terminates outwardly in a raised or stepped tip 15 (FIG. 11) which overlies and is spaced above the score line 5 in the can end flat panel wall 8.

The can end 2 (FIGS. 5 and 11) has a seam flange 16 adapted to be connected during a seaming operation to the can body 1 by the seam 3. There is a recessed corner 17 located below the seam flange 16, and the flat panel wall 8 extends inward from the recessed corner 17.

Figure 7:
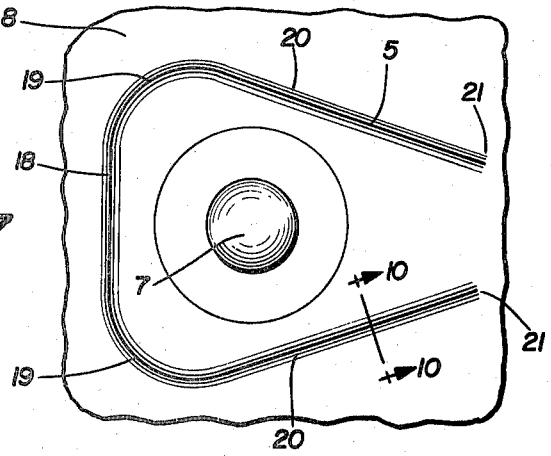
FIG. 7 is a much larger fragmentary plan view of the score line defining the pouring spout opening to be formed in the flat panel wall of the can end.

Referring to FIG. 7, the score line 5 has an outer wider straight end portion 18 connected by rounded corners 19 with inwardly converging terminal portions 20 which terminate at spaced-apart end locations 21.

Figure 6:
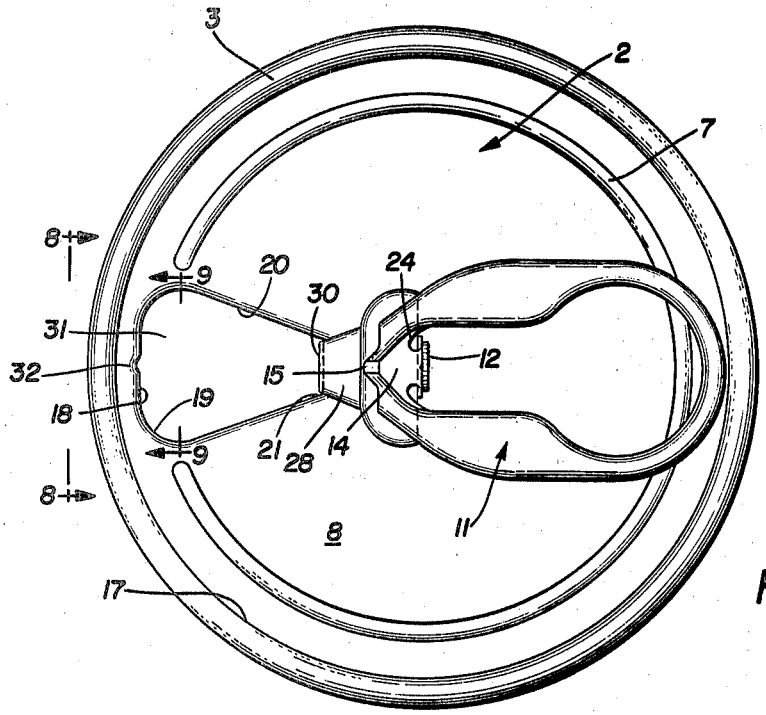
FIG. 6 is an enlarged top plan view of the can shown in FIG. 1 after having been opened to form a pouring spout opening therein.

Referring to FIG. 6, the circular reinforcing and stiffening embossment 7 projects upward from flat panel wall 8, and is located close to the can end seam 3, and extends endlessly around the flat panel wall 8 from a zone adjacent but spaced from one of the rounded corners 19 of the score line 5 to the other rounded corner 19, as shown.

The embossment 7, after the can end 2 is seamed at 3 to the can body 1, stiffens and tends to impart rigidity to the flat panel wall 8 so as to reduce drum-like movement of the wall when encountering relative pressure differentials at the outer and inner surface of the flat panel 8. Further, the stiffening and rigidifying reinforcement imparted by the embossment 7 aids in easy initial rupturing of the end wall 8 along the outer wider end portion 18 of the score line 5 which is generally aligned with the ends of the circular embossment 7.

The circular reinforcing embossment 7, the outer wider end portion 18 of the score line 5 and the stepped tip 15 of the pull tab 11 are all located closely adjacent the recessed corner 17 in the can end 2 while leaving a sufficient clearance between these components and the corner 17 for the seaming chuck used in forming the seam 3 between the can end 2 and can body 1.

Subject, however, to the space requirements for the seaming chuck, locating embossment 7, score line end portion 18 and stepped tip 15 as close as possible to the recessed corner 17 is very important for a number of reasons.

First, the embossment 7 increases in effectiveness the closer that it is to the recessed corner 17. Next, the closer the outer wider end portion 18 of the score line 5 is to the recessed corner 17, the better are the pouring characteristics of the pouring spout formed in the flat panel wall 8 when the can is opened. Last, the closer that the stepped tip 15 of the pull tab 11 is to the seam 3, spaced above but overlapping the score line portion 18, the more effective is the initial rupturing action of the pull tab in the initial phase of opening the can to rupture the residual thickness of the metal at the bottom of the score line, which residual thickness must be sufficient to prevent accidental rupture during seaming of the can end to a filled can, as well as during can contents treatment, packaging, shipment, storage and use.

The new pouring spout steel can end construction preferably is made of 75# nominal 0.0083" thick, tin-free steel, single reduced mill rolled, temper 4, 7C finish, continuous anneal, continuous cast aluminum deoxidized.

The pull tab, however, preferably is formed of aluminum and is the pull tab shown and described in U.S. Pat. No. 4,042,144. The availability, structure, strength and ease of use, as well as the provision therein of a stepped tip 15, permits its use as a part of the new end construction.

Figure 15:
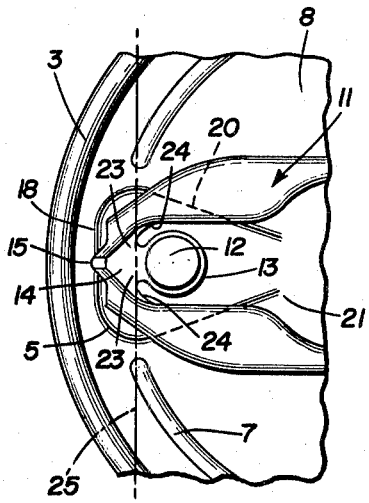
FIG. 15 is an enlarged fragmentary view similar to a portion of FIG. 1 before the can is opened.
Figure 12:
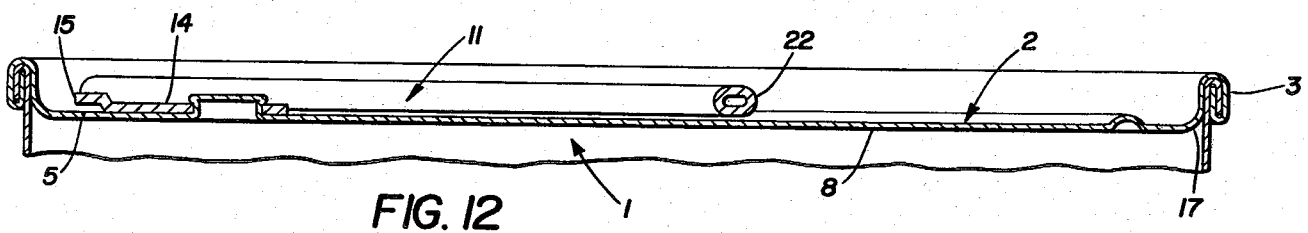
FIG. 12 is an enlarged fragmentary sectional view looking in the direction of the arrows 12—12, FIG. 1, of the upper end of a can filled with a special liquid preparation which is not to be contaminated during opening of the can.
Figure 13:
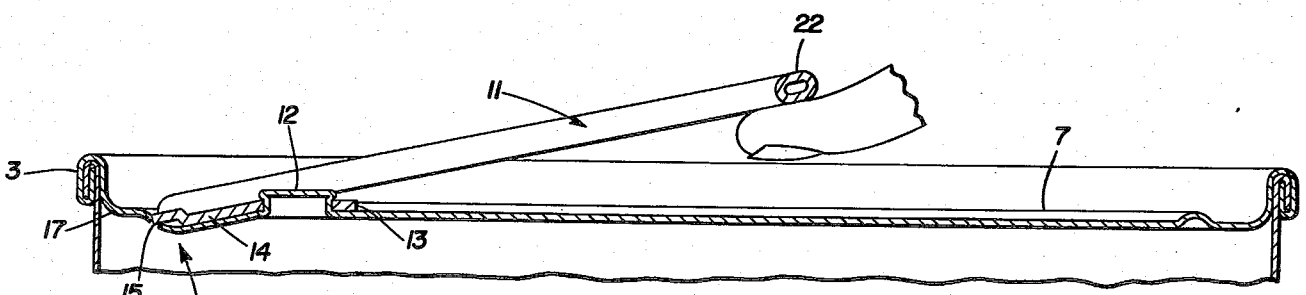
FIG. 13 is a view similar to FIG. 12 but showing the can end just after the initial stage of opening the can has taken place.
Figure 14:
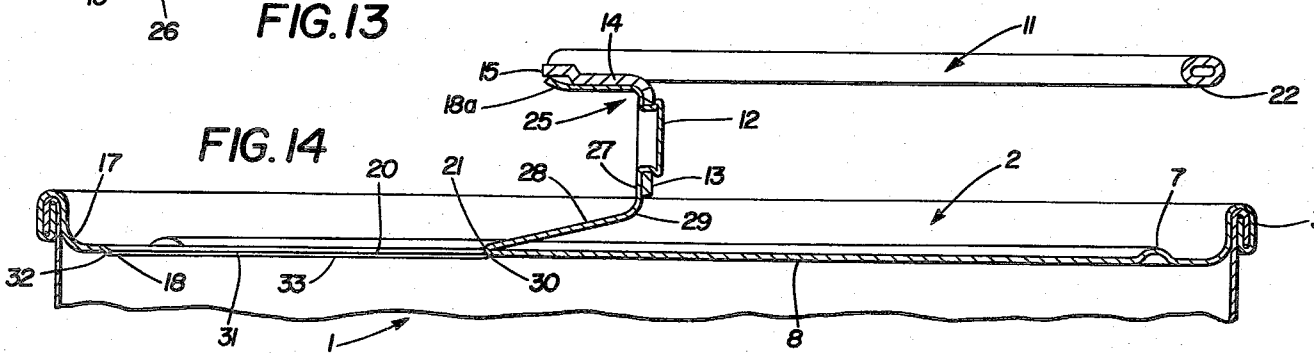
FIG. 14 is a view similar to FIGS. 12 and 13 showing the torn-away portion of the flat panel wall and the pull tab riveted thereto after forming the pear-shaped pouring spout opening, with the torn-out panel portion and the pull tab riveted thereto undetachably connected to the can.

Successive phases of the procedure for opening the can are illustrated somewhat diagrammatically in FIGS. 12, 13 and 14. The upper end of a can provided with the new pouring spout steel can end construction and containing the special liquid to be protected against contamination is illustrated in FIG. 12. In the initial phase of opening, the user's finger grasps the ring end 22 of the pull tab 11 and raises the grasped portion slightly so that the pull tab 11 acts as a lever pivoting about a bend portion of the nose bottom wall 14 extending normal to the longitudinal axis of the pull tab 11 running through the rivet 12 and stepped tip 15. The terminal end zones 23 of the slots 24, which form the ear-like portion 13 in the nose bottom wall 14, define this pivotbend portion which is indicated by the dot-dash line 25 in FIG. 15, and the zone thereof is indicated at 25 in FIG. 14.

As the lever action progresses the tip 15 of the pull tab 11 wipes into and across the center of the outer wider end portion 18 of the score line 5 and ruptures the flat panel wall 8 at this point. The rupture immediately spreads in either direction from the pull tab tip 15 along the straight length of the outer wider end score line portion 18 to the rounded corners 19, this spread initial rupture, for example, being more or less as illustrated at 26 in FIG. 13, depending upon the manner in which the user manipulates the pull tab.

The pull tab 11 then is pulled backward toward and across the center of the can top to tear and peel metal along the terminal portions 20 of the score line 5 to their ends 21 to the final open position shown in FIGS. 6 and 14.

During this backward pull the panel metal and pull tab nose bottom wall metal bend in the zone of the bend line 25 to form more or less of a right angle between that portion of the torn-out metal (FIG. 14) extending between the bend line 25 and the score line end portion 18 and a similar portion on the pull tab nose bottom wall. Depending upon the manner in which backward pull is exerted on the pull tab, the pull tab ear-like portion 13 and the torn-out metal portion 27 connected thereto by rivet 12 assume more or less of a vertical location as shown in FIG. 14.

Figure 8:
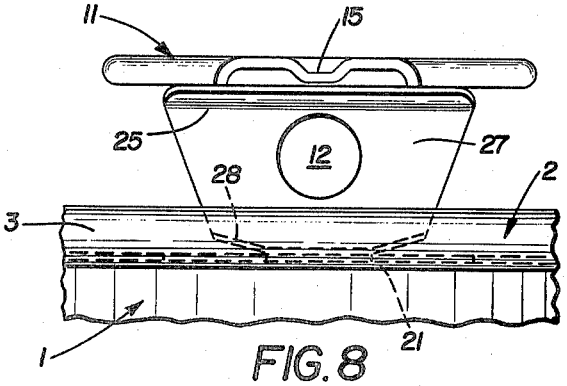
FIG. 8 is an enlarged fragmentary view looking in the direction of arrows 8—8, FIG. 6.

Another connected portion 28 of the torn-out metal bends at 29 from the torn-out portion 27 and extends to the complete overlapping bend 30 which extends between the spaced ends 21 of the terminal portions 20 (FIGS. 6 and 8).

Thus, as shown in FIGS. 6 and 14, the can is completely opened, the pouring spout opening 31 (FIG. 6) is formed, and the torn-out portions 18*a*, 27 and 28, as well as the pull tab riveted thereto, remain undetachably connected to the can 1.

Figure 9:
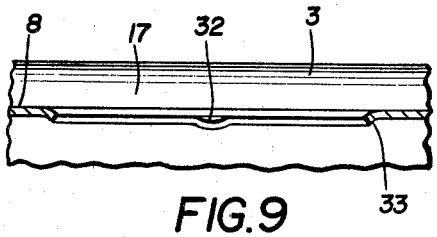
FIG. 9 is an enlarged fragmentary sectional view looking in the direction of the arrows 9—9, FIG. 6.

During the first phase of the procedure for opening the new can end construction when the stepped tip 15 of the pull tab 11 wipes across and ruptures the straight end portion 18 of the score line 5, a slight but visible indentation 32 is formed in the panel metal extending between the recessed corner 17 and the location of the straight score portion 18 (FIGS. 6 and 9).

Also, after the pouring spout opening 31 has been formed, the edge of the metal forming the opening 31 defined by the score line portions 18-19-20 has a slight downturned contour indicated at 33 in FIGS. 9 and 14 which results from the concavity 9 occurring, as described, when the score line 5 is formed in the flat panel wall metal 8.

This downturned contour 33 in addition to providing a slight stiffening of the panel wall 8 during tearing of the metal removed to form the pouring spout opening 31, also directs the raw torn edge downward rather than projecting in the plane of the panel wall 8. This reduces the likelihood of a user cutting a finger which may be accidentally brushed across the pouring spout opening 31.

Another feature of the opened pouring spout opening structure relates to the straightness of the opening 31 at the outer wider end of the pear-shaped opening. This straight opening portion close to the seam 3 provides excellent pouring characteristics for emptying the liquid contents of the can 1 when opened.

The described opening procedure indicates that in the first phase of opening, as the flat panel wall is ruptured, as illustrated in FIG. 13, the ruptured metal to be torn away and the tip 15 of the pull tab move slightly downward from the plane of the panel wall 8. However, the immediate pull on the pull tab backward toward and across the center of the can top instantly withdraws the torn-out portion out of the can and away from the opening 31. The momentary location of the torn portion below the panel 8, as shown in FIG. 13, does not constitute an insertion to any material degree of any can end metal into the can during opening. Thus, contamination of any liquid in the can is avoided. This fundamental feature of the new construction is referred to herein as forming a pouring spout opening by tearing metal from the can end wall without contaminatingly-projecting any of the torn metal into the can during opening.

Accordingly, the new pouring spout steel can end construction having the various detailed features described provides a can for liquid human food products with a steel can end which may be easily opened with an aluminum pull tab riveted to a panel portion wherein a pear-shaped pouring spout opening may be formed by tearing a panel metal from the can end without contaminatingly-projecting the torn portion into the can during opening, and without becoming detached from the can end; and provides a new can end construction which satisfies the indicated objectives simply and efficiently with a low construction cost, and which obtains the new results described and solves existing problems in the field of steel cans for special liquid food products which must not be contaminated.

In the foregoing description, certain terms have been used for brevity, clearness and understanding; but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described, since the features of the invention may be applied to different sizes and types of cans and steel can ends.

Having now described the features, discoveries and principles of the invention, the manner in which the improved structure achieves the objectives, and the advantageous, new and useful results obtained; the new and useful structures, devices, elements, arrangements, parts, cooperative relationships, and combinations are set forth in the appended claims:

I claim:

1. In a metal can end of a type having a seam flange adapted to be connected by seam means to a can body which can end has a recessed corner located below the seam flange with a flat end panel extending inward from the recessed corner, the flat panel having a pear-shaped score line therein defining a removable portion to be torn from said end panel to form a pouring spout opening when pulled by an aluminum pull tab having a ring end and a bottom nose wall connected by a rivet formed integrally in the flat panel and located close to the score line, the pull tab bottom nose wall having slots therein forming an ear-like portion to which the rivet is connected and having a stepped tip spaced from said ear-like portion; wherein the improvement comprises an annealed, tempered, tin-free steel can end; the pear-shaped score line having an outer wider straight end portion connected by rounded corners with inwardly converging terminal portions having spaced-apart ends; the outer straight end score line portion being located close to the can end recessed corner with the pull tab stepped tip overlying and spaced above the center of the outer straight end score line portion; and the pull tab bottom nose wall and panel wall riveted thereto bending on a bend line extending normal to the longitudinal axis of the pull tab which extends through the rivet and stepped tip with the bend line located between the rivet and stepped tip when the ring end of the pull tab is raised to wipe the tip into and across the score line to initially rupture the score line at said center and to spread the rupture in either direction from said center along the outer straight end score line portion.

2. The construction defined in claim 1 in which as the pull tab tip wipes into and across the score line to initially rupture the score line at said center, the tip forms an indentation at said center in ruptured panel metal extending from said can end recessed corner.

3. The construction defined in claim 1 in which continued pull on the ring end of the pull tab backward of the stepped tip tears the panel metal around the rounded corners and along the inwardly converging terminal score line portions to their ends, accompanied by further bending of the torn-out panel metal on said bend line and at a spaced location behind the rivet and at another spaced location along the space between said terminal score line portion ends to complete the formation of the pear-shaped opening; whereby a pouring spout opening is formed in the can end without contaminatingly-projecting can end metal into the container when the container is being opened.

4. The construction defined in claim 1 in which the panel metal in the scored zone has a slight embossed-like concave depression extending along the sides of the cross-sectional contour of the score line throughout its length.

5. The construction defined in claim 4 in which when panel metal has been completely torn from the can end along the entire length of the score line by backward pull on the ring end of the pull tab, the edge of the metal forming the pouring spout opening defined by the score line has a slight downturned contour throughout its length originating from the concave depression extending along the score line.

6. The construction defined in claim 1 in which a circularly located reinforcing embossment projects upward from the flat panel wall adjacent the can end seam extending endlessly around the flat panel wall from a zone adjacent but spaced from one rounded score line corner to the other rounded score line corner.

7. The construction defined in claim 1 in which a circular reinforcing embossment projects upward from the flat panel wall and is located adjacent the can end seam and extends endlessly around the flat panel wall from a zone adjacent but spaced from one rounded score line corner to the other rounded score line corner; in which the panel metal in the zone of the score line has a slight embossed-like concave depression which extends along the sides of the cross-sectional contour of the score line throughout its length; in which as the pull tab tip wipes into and across the score line initially to rupture the score line at said center, the tip forms an indentation at said center in the panel metal extending from said can end recessed corner; in which continued pull on the ring end of the pull tab, after initial rupture of the score line, backward of the stepped tip tears the panel metal around the rounded corners and along the inwardly converging terminal score line portions to their ends, accompanied by further bending of the torn-out panel metal on said bend line and at a spaced location behind the rivet and at another spaced location along the space between said terminal score line portion ends to complete the formation of the pear-shaped opening; and in which when panel metal has been completely torn from the can end along the entire length of the score line by said backward pull on the ring end of the pull tab, the edge of the metal forming the pouring spout opening defined by the score line has a slight downward contour throughout its length originating from the concave depression extending along the score line; whereby a pouring spout opening is formed in the can end without contaminatingly-projecting can end metal into the container when the container is being opened.

* * * * *